US008905573B2

(12) United States Patent
Sharrah et al.

(10) Patent No.: US 8,905,573 B2
(45) Date of Patent: Dec. 9, 2014

(54) PORTABLE LIGHT WITH HANGER, CLIP AND LED MODULE

(75) Inventors: Raymond L. Sharrah, Collegeville, PA (US); Matthew B. Dalton, Elkins Park, PA (US)

(73) Assignee: Streamlight, Inc., Eagleville, PA (US)

( * ) Notice: Subject to any disclaimer, the term of this patent is extended or adjusted under 35 U.S.C. 154(b) by 596 days.

(21) Appl. No.: 13/006,085

(22) Filed: Jan. 13, 2011

(65) Prior Publication Data

US 2012/0182727 A1 Jul. 19, 2012

(51) Int. Cl.

| | |
|---|---|
| ***F21L 4/04*** | (2006.01) |
| ***F21L 4/00*** | (2006.01) |
| ***F21V 21/088*** | (2006.01) |
| *F21Y 101/02* | (2006.01) |
| *F21V 29/00* | (2006.01) |

(52) U.S. Cl.

CPC ..... *F21L 4/005* (2013.01); *F21V 21/0885* (2013.01); *F21Y 2101/02* (2013.01); *F21V 29/20* (2013.01)

USPC ..... 362/205; 362/191; 362/194; 362/202; 362/345

(58) Field of Classification Search

CPC ..... G02C 7/08; G02C 7/086; F21Y 2101/02; G06F 3/0304; B60R 2011/0288

USPC ..... 362/23.07, 23.09, 23.1, 23.14, 23.19, 362/120, 166, 171, 194, 196, 197, 202–206, 362/208, 157, 183, 184, 199, 249.02, 198, 362/396, 545, 345, 191; 200/43.18

See application file for complete search history.

(56) References Cited

U.S. PATENT DOCUMENTS

| | | | | |
|---|---|---|---|---|
| 5,653,529 | A * | 8/1997 | Spocharski | 362/235 |
| D409,777 | S | 5/1999 | Sharrah et al. | |
| 6,350,040 | B1 | 2/2002 | Parker | |
| 6,585,400 | B2 | 7/2003 | Leen | |
| 6,633,152 | B2 | 10/2003 | Sharrah et al. | |
| 6,659,621 | B2 | 12/2003 | Sharrah et al. | |

(Continued)

OTHER PUBLICATIONS

ADARO Tecnologia, SA, "Adalit L2000" web page and pages from brochure, http://www.adalit.es/EN/HAdalitL2000EN.html, Publicacion No. EP-DA-8/1, Emision: Agosto/ 06. Rev.0, printed Apr. 18, 2011, 2 pages.

(Continued)

*Primary Examiner* — Stephen F Husar
*Assistant Examiner* — Danielle Allen
(74) *Attorney, Agent, or Firm* — Clement A. Berard, Esq.; Dann, Dorfman, Herrell & Skillman, PC

(57) ABSTRACT

A portable light may comprise: a light body having a light source near one end for emitting light in a substantially transverse direction; a switch actuator near the end of the light body for controlling the light source; and a stowable hanger affixed to the light body near the end thereof. The light body may have an external opening and a given cross-sectional shape and size for receiving a light source module having an exterior of the given cross-sectional shape and size. The light source module may comprise: a light source, a reflector, a heat sink thermally coupled to the light source, a lens, reflector, and a lens ring holding the lens. The portable light may also comprise: a clip extending adjacent the light body in a longitudinal direction, wherein the clip is rotatably mounted so as to be movable about the light body.

32 Claims, 5 Drawing Sheets

(56) References Cited

U.S. PATENT DOCUMENTS

| | | | | |
|---|---|---|---|---|
| 6,857,756 | B2 * | 2/2005 | Reiff et al. | 362/184 |
| 7,278,764 | B2 | 10/2007 | Kim | |
| 7,309,147 | B2 | 12/2007 | Martin | |
| 7,357,534 | B2 | 4/2008 | Snyder | |
| 7,401,941 | B2 * | 7/2008 | Teng et al. | 362/197 |
| 7,461,946 | B2 * | 12/2008 | Dalton et al. | 362/191 |
| 7,883,243 | B2 | 2/2011 | Snyder | |
| 2004/0201983 | A1 | 10/2004 | Yu | |
| 2006/0039139 | A1 | 2/2006 | Maglica | |
| 2007/0030672 | A1 | 2/2007 | Offiler et al. | |
| 2007/0041777 | A1 | 2/2007 | Dietz | |
| 2007/0058366 | A1 | 3/2007 | West | |
| 2007/0236920 | A1 | 10/2007 | Snyder | |
| 2008/0273329 | A1 | 11/2008 | Belek | |
| 2010/0033972 | A1 | 2/2010 | Maglica | |
| 2010/0176750 | A1 | 7/2010 | West | |
| 2010/0271814 | A1 | 10/2010 | Messinger et al. | |

OTHER PUBLICATIONS

ADARO Tecnologia, SA, "Adalit L2000-L/LB Safety Rechargeable Torch User Instructions", Publicacion No. EP-DA-8/3, Emision: Enero 08. Rev.3, date: Jul. 24, 2006, 16 pages.

Rayovac, "Rayovac light pictures", object prior to Feb. 8, 2011 (photos taken Jun. 2011), 4 pg.

Rayovac, "2AA Industrial Swivel Light with Heavy Duty Batteries", printed Feb. 8, 2011, 1 pg.

Rayovac, "Swivel-Lite pictures", ca. 1996 (photos taken Jun. 2011), 4 pages.

Rayovac, "Sportsman 2AA Swivel-Lite pictures", object prior to Feb. 8, 2011 (photos taken Jun. 2011), 6 pages.

Streamlight, Inc., "Switch Module Assembly—Redacted Copy", date prior to Jan. 2009, 2 pages.

Stuart Schneider, "Collecting Flashlights with Value Guide", Copyright © 1996, pp. cover, 18, 21, 30, 41, 42, 46, 78, 91, 101, 117, 129, 139, 151, and 156; Schiffer Publishing Ltd., Atglen, Pennsylvania, USA.

Reid Supply Company, "Rayovac Industial Flashlight, w/PR2 Bulb and Ring Hanger", printed Apr. 11, 2011, 1 page, http://www.reidsupply.com/printdetail.aspx?itm=180239.

FlashlightMuseum.com, "Eveready "Sport Gear" Yellow Florescent Lantern with Ring Hanger", printed Apr. 11, 2011, 2 pages, http://www.flashlightmuseum.com/Eveready-flashlight-f415-Sport-gear-yellow . . . .

Amazon.com, "Rayovac 3D Industrial Yellow Flashlight with Ring Hanger", printed Apr. 11, 2011, 5 pages.

Aqua-Air Industries, "Picture of LaserFlex™ 2D", date unknown, 1 page.

LED Work Light, "Ultimate Technician's Work Light", © 2010, printed Feb. 8, 2011, 2 pages.

Goodmart.com, "Rayovac 2AA Industrial Swivel light with heavy duty batteries", printed Feb. 8, 2011, 1 page.

Rayovac, "Black & Decker Lights", printed Feb. 8, 2011, 8 pages, http://www.rayovac.com/en/products/lights/black%20and%20decker.aspx.

Pelican Products, "Big Ed 3700 Photoluminescent Flashlight", printed Jul. 22, 2010, 1 page, http://www.pelican.com/lights_detail_print.php?recordID=3700PL.

Getflashlights.com, "Energizer-Eveready Flashlights", printed May 20, 2010, 5 pages, http://www.getflashlights.com/energizer_eveready.

Streamlight, Inc., "Survivor Series", © 2010, 4 pages, www.streamlight.com.

Streamlight, "Streamlight breaks new ground with portable Knucklehead", Military Suppliers and News, Nov. 11, 2011, 2 pages, http://www.armedforces-int.com . . . .

International Searching Authority, "PCT Notification of Transmittal of International Search Report and Written Opinion of the International Searching Authority, or the Declaration", International Application No. PCT/US2012/020727, May 18, 2012, 20 pgs.

* cited by examiner

PORTABLE LIGHT WITH HANGER, CLIP AND LED MODULE

The present invention relates to a portable light and light source module, and in particular, to a portable light having a hanger, a clip and/or a light source module.

Portable lights, e.g., flashlights, have been available in several configurations so as to be better suited for use in particular situations. One of the most common is the in-line light that typically has a battery in an elongated, usually cylindrical, barrel with a light source at one end thereof so as to project light outward generally along the longitudinal axis of the light. Variants of the in-line light usually have a switch for controlling the light that is located on the side of the light barrel or at the tail end of the light barrel, or both, and may have the light directed off the longitudinal axis by a small amount. The in-line light is convenient if held in hand in certain positions, but generally is not easily used for illumination when clipped to a pocket or belt or when placed on a horizontal surface.

Another common configuration is the 90° light that typically has a battery in an elongated, usually cylindrical, barrel with a light source arranged to project light outward at about 90° to the longitudinal axis of the light barrel. The 90° light usually has a switch for controlling the light that is located on the side of the light barrel. The 90° light is convenient if held in certain positions and may be used for illumination when clipped to a pocket or belt and when placed on a horizontal surface, although the directions in which light may be directed are quite limited.

More complex light configurations allowing greater flexibility in directing light in various directions have been developed. For example, the lantern-style FIREBOX® light and LITEBOX® light available from Streamlight, Inc. of Eagleville, Pa., have a pivotable head attached to a box-like base which is a body that contains the battery. A further example is the SYCLONE® light also available from Streamlight, Inc. which has a clip on the cylindrical body which contains the battery and has a pivotable light source head attached to the cylindrical body. A still further example is the SIDEWINDER® light available from Streamlight, Inc. which has a rotatable clip on a cylindrical battery container and has a pivotable light source container housing plural LED light source adjacent to the battery container. Yet another example is the KNUCKLEHEAD® light available from Streamlight, Inc. which has a stowable hanger and a magnet on the body which contains the battery and has a rotatable and pivotable light source head attached to the body. In each example the arrangement for pivoting and/or rotating the light source adds complexity and cost to the light.

Many conventional lights have light sources mounted in the light bodies in a way that requires assembly of plural parts, e.g., a reflector, lens, light source, control circuit board, heat sink, and the like, and which also permits user disassembly. Many modern light emitting diode (LED) lights, as well as certain incandescent, halogen and xenon lights, have electronic circuits that control operation of the light source, including, for example, but not limited to, the current flowing in the light source that causes the light source to produce light. Control of current of an LED or other light source may be employed to control brightness, operating temperature, efficiency, operating mode, e.g., flashing and/or dimming, and the like. In some instances the electronic control circuit and LED may be calibrated to each other for proper and/or desired and/or optimum performance, and/or their assembly may require steps for alignment or thermal coupling, e.g., between LED and heat sink, and so disassembly by a user or other unauthorized personnel can lead to operating and/or reliability issues.

Applicant believes there may be a need for a light improving on one or more of the foregoing limitations.

Accordingly, a portable light may comprise: a light body having a cavity for a source of electrical power; a light source proximate an end thereof oriented for emitting light in a substantially transverse direction; a switch actuator proximate the end of the light body for controlling the light source; and a stowable hanger affixed to the light body proximate the end thereof.

According to another aspect, a portable light may comprise: a light body having a first cavity having an external opening and a given cross-sectional shape and size; an actuator on the light body for controlling a light source, and a light source module having an exterior of the given cross-sectional shape and size for being placed into the first cavity of the light body.

The light source module may comprise: a light source; a reflector having a surface for reflecting the light produced by the light source; a heat sink thermally coupled to the light source; a lens covering an open end of the reflector; and a lens ring holding the lens adjacent the reflector. The light source, reflector, heat sink, lens and lens ring may form an integral module that is securable in the cavity of the light body.

According to a further aspect, a portable light may comprise: a light body; a light source proximate an end of the light body and oriented for emitting light in a substantially transverse direction; a switch actuator proximate the end of the light body for controlling the light source; and a clip extending adjacent the light body in a longitudinal direction, wherein the clip is rotatably mounted so as to be movable about the light body.

BRIEF DESCRIPTION OF THE DRAWING

The detailed description of the preferred embodiment(s) will be more easily and better understood when read in conjunction with the FIGURES of the Drawing which include.

Figure 1B:
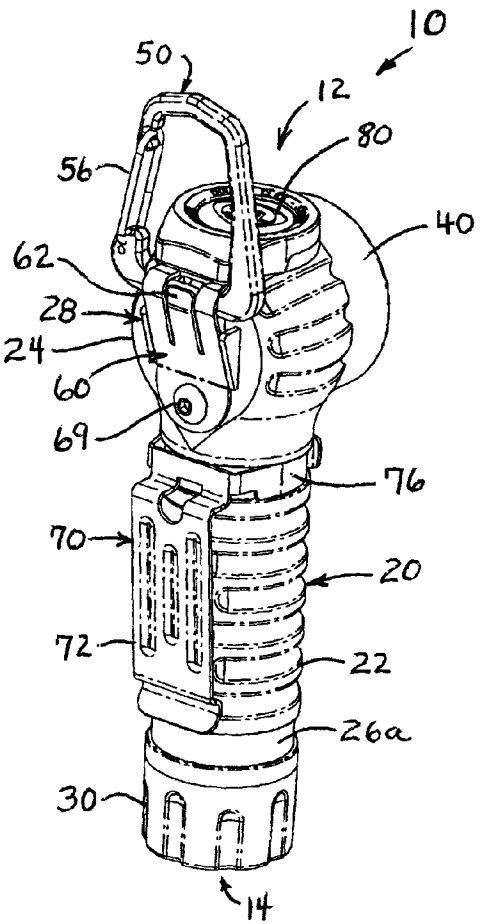
FIGS. 1A and 1B are front and rear perspective views of an example embodiment of a portable light.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification. According to common practice, the various features of the drawing are not to scale, and the dimensions of the various features may be arbitrarily expanded or reduced for clarity, and any value stated in any Figure is given by way of example only.

DESCRIPTION OF THE PREFERRED EMBODIMENT(S)

Figure 1A:
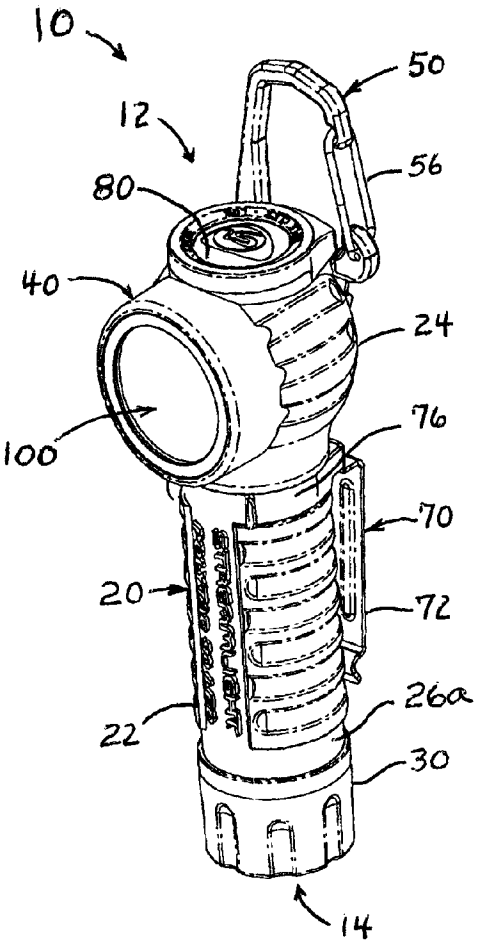
Figure 2:
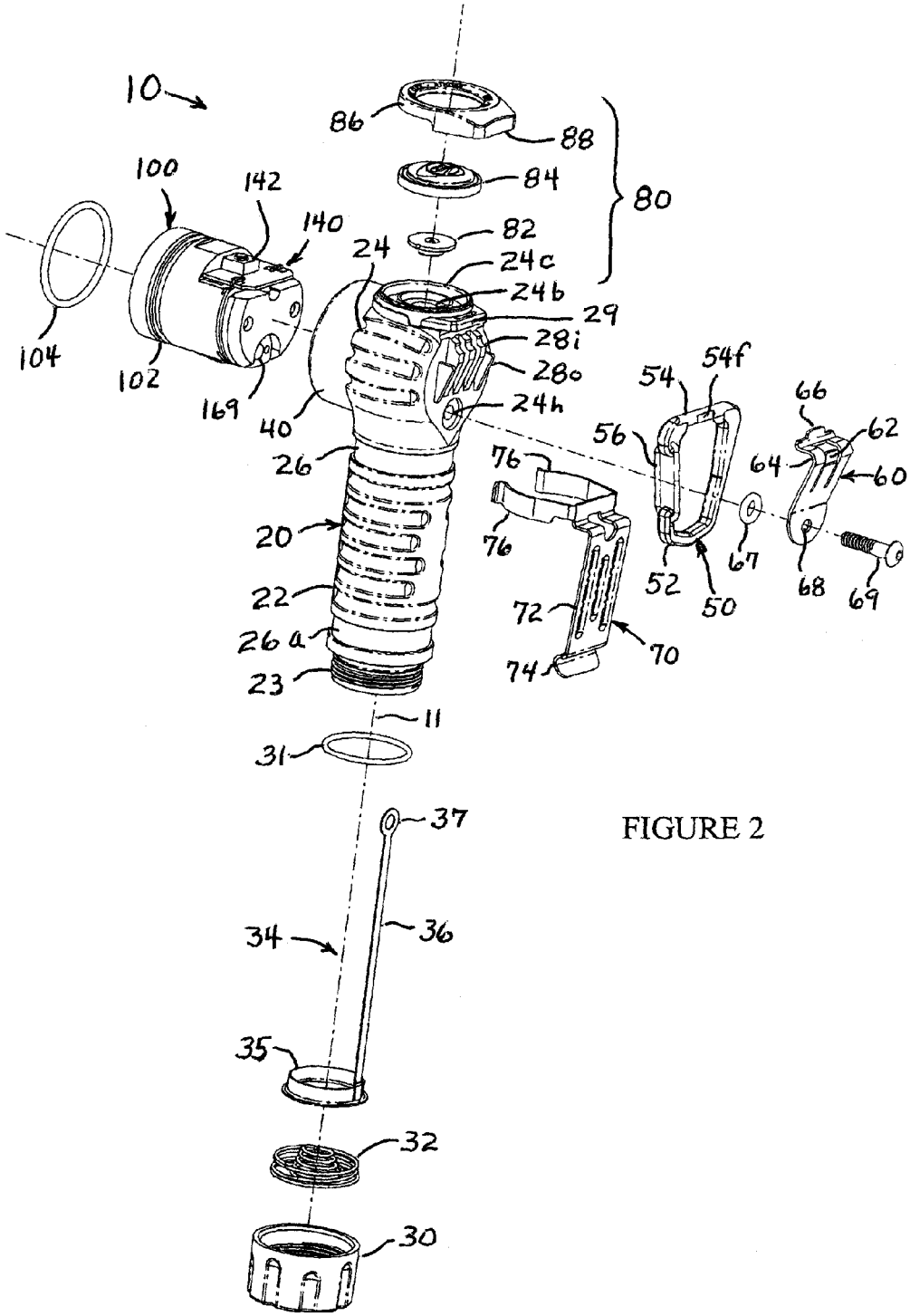
FIG. 2 is an exploded view of the example portable light of FIG. 1.
Figure 3:
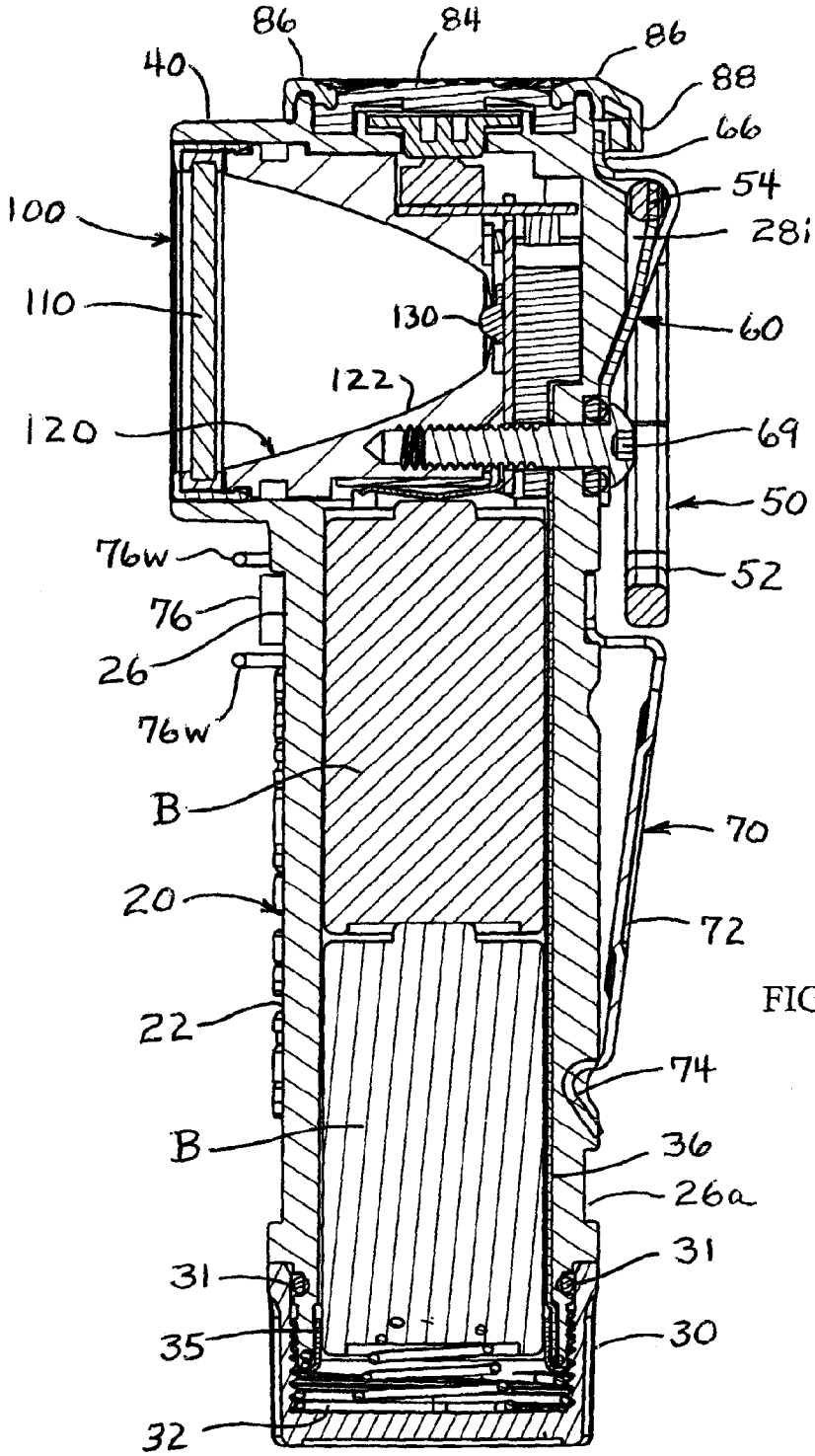
FIG. 3 is a side cross-sectional view of the example portable light of FIG. 1.

FIGS. 1A and 1B are front and rear perspective views of an example embodiment of an example portable light 10, FIG. 2 is an exploded view thereof, and FIG. 3 is a side cross-sectional view of the example portable light 10 of FIG. 1. Light 10 includes a light body 20 having an elongated body portion 22 with an internal cavity for receiving one or more batteries or other source of electrical power therein, and having a light head 24 with an extension 40 for receiving a light source such as light source module 100 therein. Switch actuator 80 is disposed at the top of head 24 at end 12 of light 10 and tail cap 30 attaches to body portion 22 to close the bottom or tail end 14 thereof. Light 10 includes a hanger ring 50, preferably a ring 50 in the general shape of a letter "D" (i.e. a "D-ring") that is stowable against light body 20 and is deployable to extend from light body 20 for hanging light 10 on any suitable thing. D-ring 50 is deployed and stowed easily with a flick or flip with a finger. Light 10 also includes a mounting clip 70 suitable for clipping light 10 to, e.g., a user's pocket or belt.

Light 10 is preferably configured as a ninety-degree (90°) light that projects light in a direction that is generally perpendicular to a longitudinal axis 11 of the elongated body 20 of light 10, and to that end a 90° extension 40 of head 24 extends from body 20 for defining a bore that receives light source module 100 therein. In a preferred embodiment, extension 40 and its bore are generally cylindrical as is the exterior of light source module 100, and are approximately perpendicular to the longitudinal axis 11 of elongated light body 22, although they can be of other shapes and can be at an angle substantially different from 90°. An example light source module 100 typically includes a lens 110, a reflector 120 having a reflective surface 122 and a light source 130, typically a light emitting diode 130 in many instances.

D-ring 50 has a ring portion 52 and a generally straight portion 54 and is attached to light body 20 by D-ring bracket 60. Ring portion 52 may be any suitable shape, e.g., circular, arcuate, segmented and the like, and may be continuous or may have a gap therein, e.g., a gap that may be closed by wire gate or clip 56. Wire gate 56 includes a loop of music wire having ends that are bent to extend into a pair of spaced apart holes in D-ring 50 so as to have a spring action returning gate 56 to a closed position whereat the loop of gate 56 bears against ring portion 52. Ring portion 52 may have a notch therein to provide a seat for gate 56. Straight portion 54 is disposed in a passage defined by a recess 64 of bracket 60 and by features 28 on the rear surface of head 24 of light body 20.

When light 10 hangs by D-ring 50, actuator 80 is naturally at the top where it may easily be pressed with one finger (hanger 50 supports light 10) for controlling operation of light 10, and so is quite convenient for hands-off use. This is because hanger 50 is attached to light body 20 near the head end 12 thereof and so it hangs from an object that is above almost all of the weight of light 10 giving it substantial stability. With substantially 90° head orientation with respect from body portion 22, light 10 conveniently provides illumination generally horizontally with light 10 hanging by D-ring 50.

Recess 64 is defined by a bend in bracket 60 which may be attached to light body 20 at one end by a fastener 69 through hole 68 into hole 24*h* and at the other end by a tab or extension 66 engaging a recess provided by light body 20, e.g., by projection 29 that defines an opening 29*r* which may be covered by extension 88 of cover ring 86. Bracket 60 has a pair of slots therein that define a spring finger 62 that extends over the passage between bracket 60 and light body 20 to press against the straight portion 54 of D-ring 50. Preferably the generally straight portion 54 of D-ring 50 has one or more flats (flat sections) 54*f* thereon so that spring finger 62 bearing thereon urges D-ring 50 to prefer one or more positions, or detents, defined by the flats 54*f*. Preferably, two flats 54*f* are provided about 180° apart so that D-ring 50 tends to remain in a deployed position (e.g., FIGS. 1A, 1B) or in a stowed position (e.g., FIGS. 2 and 3) adjacent light body 20.

Light body 20 has features, e.g., raised ridges, 28 on the rear of head 24 for positioning D-ring bracket 60 and defining the passage in which straight portion 54 of D-ring 50 is disposed. For example, two outer generally triangular ridges 28*o* are spaced apart by about the width of bracket 60 and are about the height of bracket 60 from head 24 so as to position bracket 60 laterally by its edges. One or more inner ridges 28*i*, e.g., three inner generally trapezoidal ridges 28*i*, provide along part of their edges raised areas having generally circular recesses that define for light body 20 the side of the passage that is opposite bracket 60 and adjacent which the straight portion 54 of D-ring 50 is disposed. Inner ridges 28*i* have a height so that they do not contact bracket 60 and particularly spring finger 62 thereof. Bracket 60 is positioned longitudinally by tab 66 at the upper end thereof residing in a recess 29*r* of housing 20 and at its lower end by fastener 69 in hole 24*h* of housing 20. Recess or opening 29*r* may be defined by a projection or loop 29 extending from head 24 of housing 20 which is covered at its upper end by extension 88 of cover ring 86.

Clip 70 on light body 20 has an extension 72 that extends longitudinally along and adjacent to light body 20 towards the tail end 14 thereof for enabling light 10 to be clipped or attached to, e.g., a pocket, belt, other clothing or equipment, or another object. Longitudinal extension 72, which in one example is generally rectangular, may have a bend at the distal end thereof to define a ridge 74 extending towards light body 20 to more securely hold light 10 to the pocket, belt, or other object, to which light 10 may be attached.

Preferably, clip 70 is mounted along the side of light body 20 opposite the direction in which light is emitted from light source module 100, but is not fixedly mounted which would tend to project light in a fixed direction. Preferably clip 70 is rotatable adjacent light body 20 about the longitudinal axis 11 of light 10 so that the light produced thereby can be directed over a range of directions.

So as to be rotatable about elongated light body portion 22, clip 70 may have a pair of arcuate (curved) members 76 that extend generally perpendicularly from longitudinal extension 72 to encircle and grip light body 20. In one example, arcuate members 76 reside in a circumferential groove 26 in the elongated body 22 of light body 20 and are movable therein for rotating clip 70 around light body 20 to any position. While clip 70 may be rotated around light body fully in either of both directions, only about 200° of rotation is usable when light 10 is attached by clip 70 to a user. While not required, arcuate members 76 may be bent outward at their respective distal ends (e.g., tips) for receiving an optional clasp 76*w*, such as a music wire clasp 76*w*, so as to be more strongly retained on light body 20.

A switch actuator 80 is provided, preferably at the top end 12 of light 10, for controlling the operation of light 10. While actuator 80 may be an electrical switch that controls operation of light 10, in one example embodiment actuator 80 is for actuating an electrical switch 142 of light source module 100 located inside of light body 20. Therein, actuator 80 may include a switch actuator 82 that is seated movably in an axial bore 24*b* in light head 24 and actuator 82 may be covered by a flexible actuator cover 84, e.g., for excluding dirt and debris that is held in place by cover ring 86. Cover 86 which is secured to head 24 may have an extension 88 that provides a cover over projection 29 and an upper end of recess 29*r* of housing 20 which receives tab 66 of ring bracket 60 which is attached to light body 20.

Light source module 100 fits into 90° extension 40 of light body 20 and may include an O-ring 102 in a circumferential groove therein for providing a seal between the exterior surface of light source module 100 and the interior surface of 90° extension 40. Module 100 may be secured in head 24 of light body 20 by fastener 69 passing through bracket 60, hole 24*h* of light body 20, and into hole 169 of module 100. Fastener 69 may, e.g., be a threaded fastener 69 engaging threaded hole 169 or may be another kind of fastener. Switch 142 of light source module 100 resides in head 24 adjacent switch actuator 82 so as to be actuatable by pressing on flexible cover 84 thereby to apply pressure to switch 142 via movable actuator 82.

As may more easily be seen in relation to FIGS. 2 and 3, one or more batteries B can be placed in a cavity interior to the elongated barrel 22 of light body 20, e.g., with their like polarity, e.g., positive, terminals closer to light source module 100 where it contacts battery contact 144. The opposite polarity, e.g., negative, terminal of the rearward battery B electrically contacts a contact spring 32 in tail cap 30. Contact spring 32 urges battery B forward so that forward battery B comes into contact with battery contact 144 of light source module 100. Contact spring 32 has an inner coil which contacts battery B and an outer or larger diameter coil which contacts ring conductor 35. Tail cap 30 threads onto tail threads 23 of light body 22 and may be sealed by an O-ring 31.

An internal conductor 34 may provide electrical connection between the rearward, e.g., negative, battery B terminal and light source module 100 via contact spring 32. Internal conductor 34 may have a ring conductor 35 disposed adjacent the tail end of barrel 22 making contact with the outer coils of coil spring 32 while the inner or central coils of coil spring 32 contact the rearward end of rearward battery B. Internal conductor 34 includes a longitudinal conductor 36 that extends through light body 22 to connect via its contact ring 37 to the rear of light source module 100 where fastener 69 engages hole 169 thereof. Preferably longitudinal conductor 36 resides in a longitudinal groove in the interior wall of the battery cavity of light body barrel 22.

Figure 4A:
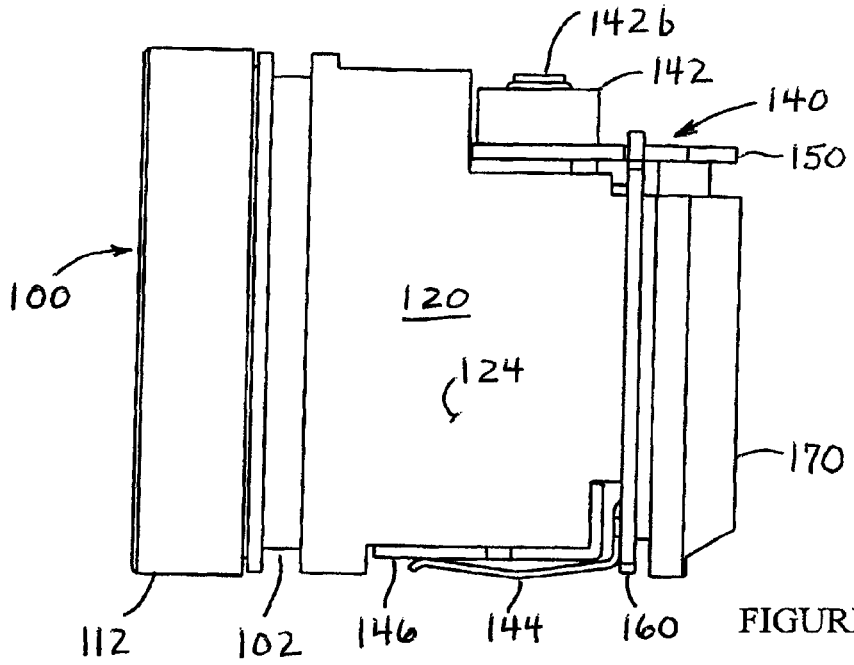
FIGS. 4A and 4B are side and perspective views, respectively of an example light source module of the example portable light of FIG. 1.
Figure 4B:
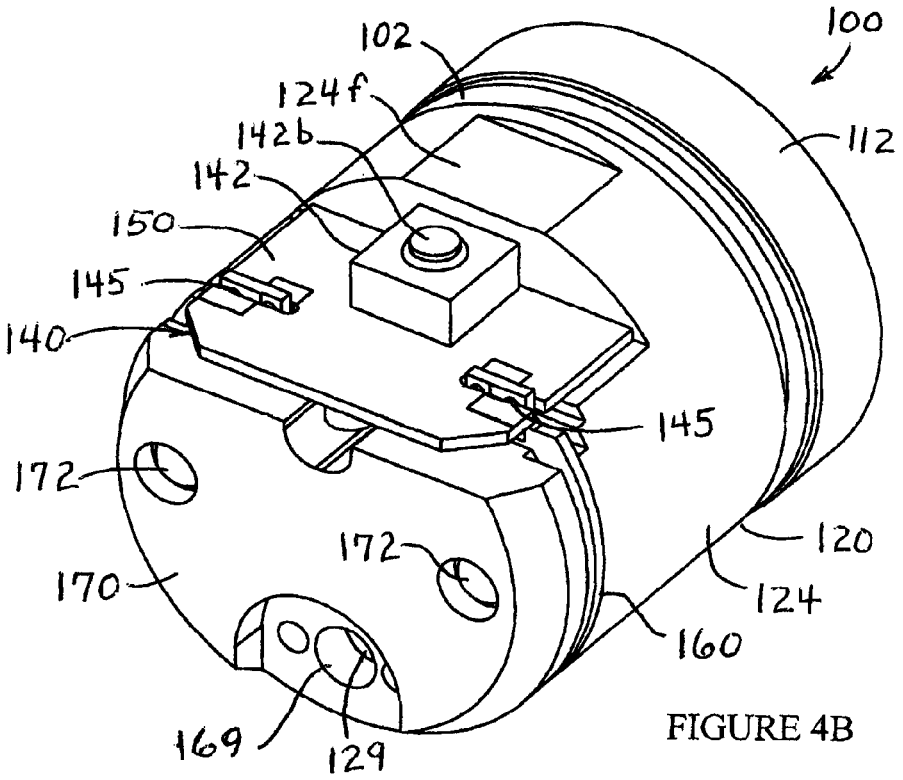
Figure 5:
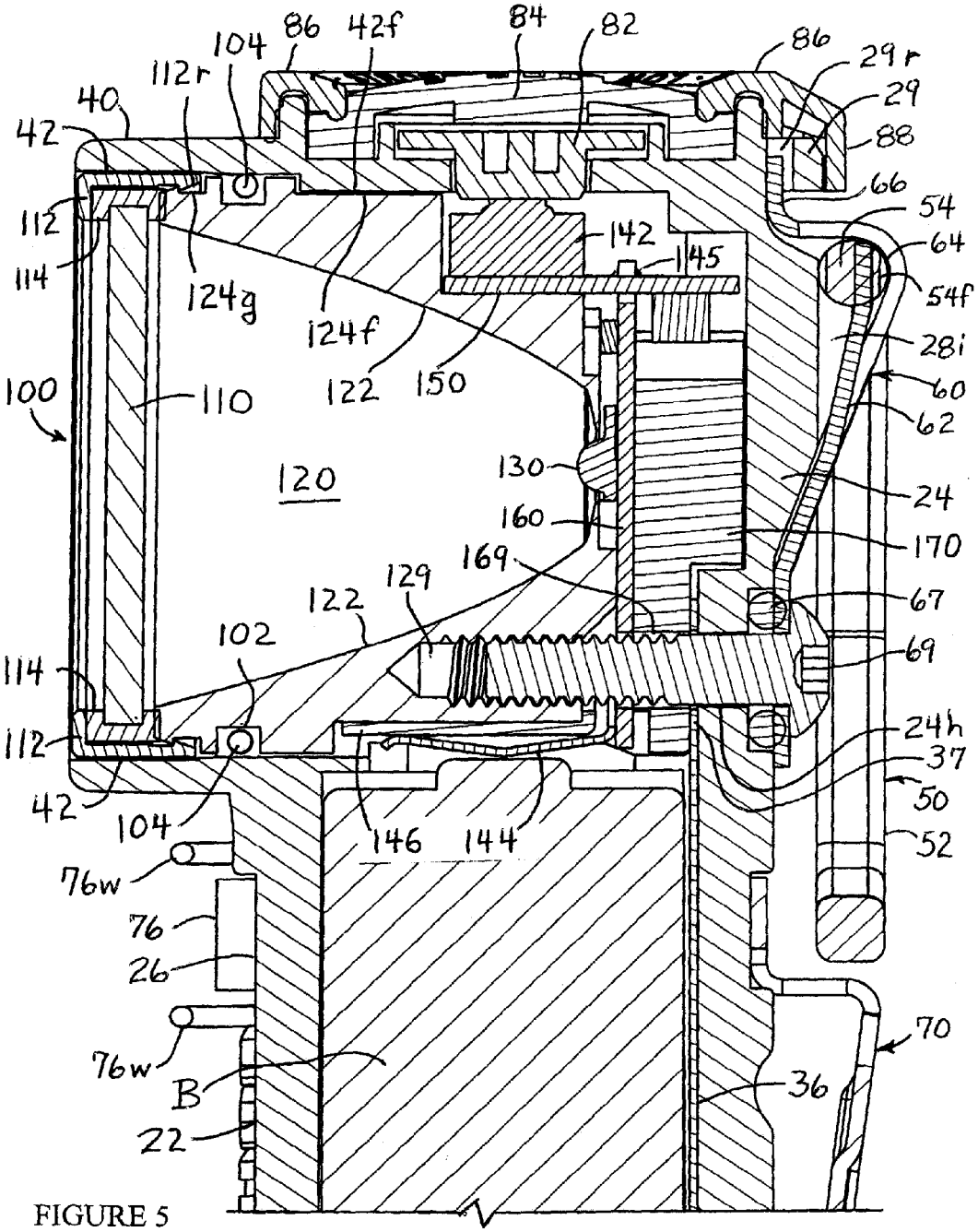
FIG. 5 is an expanded side cross-sectional view of the head portion of the example portable light of FIGS. 1 and 3 showing the example light source module therein.

FIGS. 4A and 4B are side and perspective views, respectively of an example light source module 100 of the example portable light 10 of FIG. 1, and FIG. 5 is an expanded side cross-sectional view of the head portion 24 of the example portable light 10 of FIGS. 1 and 3 showing the example light source module 100 therein. Light source module 100 is a complete or integrated assembly that can simply slip into the bore or interior of extension 40 of light body 20, thereby avoiding the assembly of the multiple parts of the typical conventional light, e.g., a separate lens, lens ring, reflector, light source and heat sink, that tend to complicate assembly of the light and/or the replacement of a part thereof, e.g., a light source or a battery wherein the battery is accessed via the opening in which the light source resides.

Light source module 100 has a shape compatible with the shape and size of the interior 42 of body extension 40, e.g., a generally cylindrical shape 124, and has a lens 110 at one end, e.g., the forward end, and a heat sink 170 at the other end, e.g., the rear end. Light source module 100 is typically of smaller diameter than is the bore 42 of extension 40 so as to slip therein, and preferably has an optional circumferential groove 102 in its outer surface 124 in which an optional O-ring 104 resides. O-ring 104 typically provides sufficient additional diameter so as to provide a seal between light source module 100 and the interior 42 of extension 40.

Module 100 and light body 20 may have respective indexing features to control and/or limit the radial orientation at which light source module 100 may be inserted into the bore 42 of extension 40 of light body 20. For example, the bore 42 of extension 40 may have a flat extension 42*f* thereon, e.g., near the top adjacent actuator 82, and reflector 120 may have a flat recess 124*f* thereon, e.g., adjacent switch 142, so that the pairing of flats 42*f*, 124*f* restricts the radial orientation of module 100 in bore 42 to that at which switch 142 and actuator 82 are aligned for cooperation. Because all of the other features of module 100 and of light body 20 may be in known locations relative to flats 124*f* and 42*f*, respectively, light source module 100 and its features will be properly aligned with light body 20 and its features when therein.

When light source module 100 is fully inserted into bore 42 of extension 40 of light body 20, electrical switch 142 of module 100 is positioned adjacent actuator 82 so as to be actuatable thereby, and battery contact 144 of module 100 is positioned adjacent an opening to the battery cavity of light body 20 so as to be contactable by the forward end of a battery B therein. Connection of light module 100 to the rearward end of battery B is via contact spring 32 and internal conductor 34 of which contact ring 37 contacts heat sink 170 and is pressed there against by the action of fastener 69 which thereby serves plural functions.

Light source module 100 may be retained in light body 20 by any convenient means, of which a fastener 69 is one. E.g., a fastener 69 which passes through hole 68 of bracket 60, through hole 24*h* of head 24 of light body 20 and into a securing hole 129, 169 (e.g., a typically through hole 169 in heat sink 170 and an engaging hole 129 in reflector 120) of light source module 100 may serve to retain module 100 in light body 20. Optionally, an O-ring 67 may be disposed in hole 24*h* for being compressed by bracket 60 and fastener 69 for providing a seal thereat.

In this example, reflector 120 may be thought of as providing the main element of light source module 100. Example reflector 120 provides much of the shape and exterior surface 124 of module 100, as well as having a curved reflective surface 122, possibly a parabolic or parabola-like surface 122, for reflecting light produced by a light source 130 disposed so as to be at an opening in reflector 120, e.g., typically a light emitting diode 130 that is mounted to a circuit board 160 so as to extend in whole or in part into the interior of reflector 120 to emit light that at least in part impinges on reflector surface 122.

LED circuit board 160 is adjacent the rearward end of reflector and has heat sink 170 adjacent thereto. Typically, one or more fasteners 172 serve to attach heat sink 170 to reflector 120 with LED circuit board 160 therebetween. LED circuit board 160 typically provides sufficient thermal conductivity (e.g., thermal coupling) to conduct heat produced by LED 130 to heat sink 170 and to reflector 120. Thermal coupling may be enhanced by thermally conductive grease, by thermally conductive adhesive, or by other thermally conductive material at the various interfaces.

Recesses in the generally cylindrical shapes of reflector 120 and heat sink 170 provide a space where a circuit board 140 may be disposed. Specifically, in this example, circuit board 140 includes a control circuit board 150 and an LED circuit board 160. Circuit boards 150, 160 may be joined where a tab or tabs extend from one into a slot in the other, where both the tabs and slots have solderable features, e.g., copper conductor areas, for soldering circuit boards 150 and 160 together, e.g., as circuit board 140. The solder 145 connections between circuit boards 150, 160 may provide only a mechanical connection, but preferably provide one or more electrical connections between circuit boards 150, 160 through which electrical power may be supplied from a control circuit on circuit board 150 to energize the LED on circuit board 160.

The control circuit for controlling the energizing and operation of light source 130 may be of any suitable type or kind. In a preferred arrangement, the control circuit is a controller including a microprocessor that can provide multiple operating modes in response to actuation of switch 142 and to the number and/or timing of plural actuations. Examples of suitable controllers and/or control circuits may be found in, e.g., U.S. Pat. No. 7,215,084 entitled "Power Control Arrangement, as for a Flashlight," U.S. Pat. No. 7,466,082 entitled "Electronic Circuit Reducing and Boosting Voltage for Controlling LED Current," U.S. Pat. No. 7,674,003 entitled "Flashlight Having Plural Switches and a Controller," and/or U.S. Pat. No. 7,652,216 entitled "Electrical Switch, as for Controlling a Flashlight," all assigned to Streamlight, Inc., the assignee of this patent application, and each and all of which are hereby incorporated herein by reference in their respective entireties.

An electrical switch 142 mounted, e.g., on circuit board 140, 150 may be employed to control the energization and operation of light source 130 in response to actuating presses applied to actuator 82 through flexible actuator cover 84 to actuate pushbutton 142*b* of switch 142. Actuator 82 and cover 84 are typically assembled to light body 20, e.g., by securing cover ring 86 thereon by any convenient method, e.g., by adhesive, chemical welding, ultrasonic welding and the like. Actuator 82 has a top-hat like shape with the crown extending into bore 24*b* and the brim adjacent the end thereof. Cover 84 may have a raised portion in a central region so as to more directly and centrally bear against actuator 82, and is preferably of a flexible resilient material so as to provide a seal, e.g., around its periphery whereat it is clamped by cover ring 86. Cover 84 and cover ring 86 may have one or more features, or may have complementary features, such as ridges and/or recesses, that may serve to enhance sealing.

Lens 110 is disposed adjacent the open or forward end of reflector 120 and is secured thereon by a lens ring 112 that slips onto the forward end of reflector 120. Lens ring 112 is preferably retained thereon, e.g., by adhesive or even by a sufficiently tight fit. To that end, reflector 120 may have a groove 124*g* near its forward end that receives an inwardly extending ridge 112*r* of lens ring 112 as illustrated, to essentially permanently retain lens ring 112 on reflector 120. A lens gasket 114 may be employed as a seal, or as a cushion where lens 110 is of a rigid material, e.g., a glass lens 110. Because lens 110 and lens ring 112 and other parts are integrally part of module 100 which is like a cartridge that is placed into light body 20, light 10 does not have many of the piece parts commonly found in conventional lights.

It is pointed out that the retention of tab 66 of bracket 60 in a recess in an extension 29 of housing 20 as described above, and the straight portion 54 and flats 54*f* of D-ring 50 in the passage adjacent inner ridges 28*i* and recess 62 of bracket 60, may also be seen in FIG. 5. Spring finger 62 of D-ring bracket 60 is illustrated therein in a location to which it would relax if D-ring 50 were not present, e.g., if spring finger 62 is not bearing against flats 54*f* of straight portion 54 of D-ring 50.

Battery contact 144 is adjacent surface 124 of module 100, preferably adjacent a flat place thereon, and is insulated from contacting reflector 120 by an insulator 146 disposed between contact 144 and reflector 120. Contact 124 is preferably attached and electrically connected to circuit board 160 for providing electrical connection between the control circuit and light source disposed on or connected to circuit board 140. Circuit board 160 may be retained by being captured between reflector 120 and heat sink 170, both of which may be of an electrically conductive material. Unwanted electrical connection between circuit board 160, reflector 120 and/or heat sink 170 may be provided by a physical insulator or insulators therebetween, or by not having an electrical conductor of circuit board 160 in a location that touches reflector 120 and/or heat sink 170.

In one typical example portable light 10, the light body 20 and tail cap 30 may be molded of nylon, polycarbonate, ABS plastic or other suitable plastic, D-ring 50 may be cast aluminum, die cast zinc, spring steel, stainless steel, or other suitable metal or plastic, and D-ring bracket 60 and clip 70 may be steel, spring steel, plated steel, stainless steel, three-quarters or other hardened steel, or other suitable metal with music wire gates. In a typical example LED light source module 100, reflector 120, heat sink 170 and lens ring 112 may be aluminum, zinc, steel, stainless steel, or other suitable material and circuit boards 140, 150, 160 may be FR4, ceramic, metal core, FRP circuit board, or another suitable circuit board material. Battery contact 144 and internal conductor 134 may be brass, copper, beryllium copper, or other suitable metal. Lens 110 may be glass, float glass, polycarbonate, or other suitable transparent material.

In one typical example of a portable light 10, light body 20 has a length of about 4.25 inches (about 10.8 cm) and barrel 22 thereof has a diameter or about 0.9-1.0 inches (about 2.3-2.5 cm). Light source module 100 has length of about 1.2 inches (about 3 cm) and an outer diameter of about 1.10 inches (about 2.79 cm) and bore 42 has a diameter of about 1.12 inches (about 2.84 cm). Clip 72 is about 0.6 by 1.6 inches (about 1.5 by 4.1 cm). Therein, light 10 utilizes two type CR123A three-volt lithium batteries. LED 130 may be a Rebel type available from Philips Lumileds, located in San Jose, Calif. or an XPE type available from Cree Semiconductors, located in Durham, N.C.

A portable light 10 may comprise: a light body 20 defining a longitudinal axis 11 between first and second ends 12, 14, and having a cavity for receiving a source B of electrical power therein; a light source 100 proximate the first end 12 of the light body 20 and oriented for emitting light in a direction substantially transverse to the longitudinal axis 11 of the light body 20; a switch actuator 80 proximate the first end 12 of the light body 20 for controlling the light source 100 for selectively producing light, and a stowable hanger 50 affixed to the light body 20 proximate the first end 12 thereof. The light source 100 may emit light substantially perpendicularly to the longitudinal axis 11 of the light body 20; or the light source 100 may be substantially at the first end 12 of the light body 20; or the switch actuator 80 may be at the first end 12 of the light body 20; or the stowable hanger 50 may be substantially at the first end 12 of the light body 20; or the light source 100 and the stowable hanger 50 may be substantially at the first end 12 of the light body 20 with the stowable hanger 20 opposite the light source 100; or any combination of any of the foregoing. The stowable hanger 50 may comprise: a bracket 60 affixed to the light body 20 and defining a relatively straight passage between the bracket 60 and the light body 20, the bracket 60 including a spring finger 62 proximate the passage; and a hanger ring 50 having a relatively straight portion 54 having at least first and second flat surfaces 54*f* thereon disposed in the passage and engaging the spring finger 62 of the bracket 60, wherein the spring finger 62 of the bracket 60 bears against the first flat surface 54*f* of the hanger ring 50 for biasing the hanger ring 50 to a stowed position and bears against the second flat surface 54*f* of the hanger ring 50 for biasing the hanger ring 50 to a deployed position. The stowable hanger 50 may include a hanger ring 52 having a spring-loaded clip 56 closing an opening in the hanger ring 52. In the portable light 10: the stowable hanger 50 may be affixed to the light body 20 by a fastener 69; or the stowable hanger 50 may be affixed to the light body 20 by a fastener 69 that extends through the light body 20 to engage the light source 100 therein. The portable light 10 may further comprise: a clip 70 extending adjacent the light body 20 in a longitudinal direction, wherein the clip 70 is rotatably mounted to the light body 20 so as to be movable adjacent the light body 20 about the longitudinal axis 11 thereof.

A portable light 10 may comprise: a light body 20 having a first cavity 42 having a given cross-sectional shape and size and having a second cavity for receiving a source B of electrical power therein, the first cavity 42 having an external opening for receiving a light source module 100 therein; an actuator 80 on the light body 20 for controlling energizing a light source for selectively producing light when a source B of electrical power is in the second cavity, and a light source module 100 having an exterior 124 of the given cross-sectional shape and size for being placed into the first cavity 42 of the light body 20, the light source module 100 may comprise: a light source 130 for producing light when energized; a reflector 120 for receiving light from the light source 130 and having a surface 122 for reflecting the light produced by the light source 130 towards an open end of the reflector 120; a heat sink 170 attached to the reflector 120 and thermally coupled to the light source 130; a lens 110 covering the open end of the reflector 120; and a lens ring 112 holding the lens 110 adjacent the reflector 120, wherein the light source 130, the reflector 120, the heat sink 170, the lens 110 and the lens ring 112 form an integral module 100 that is insertable into and securable in the first cavity 42 of the light body 20. In the portable light 10: the given cross-sectional shape and size may be substantially cylindrical; or the reflector 120 may have an external surface 124 of the given cross-sectional shape and size; or the reflector 120 may have a substantially cylindrical external surface 124 of the given cross-sectional shape and size; or the reflector 120 may have an external surface 124 having a circumferential groove 102 therein and an O-ring 104 in the groove 102. The lens ring 112 may press fit on the external surface of the reflector 120 for securing the lens 110 against the open end of the reflector 120. The heat sink 170 may attach at a rearward end of the reflector 120 with the light source 130 thermally coupled thereto, and the reflector 120 may have an opening in the rearward end for receiving light from the light source 130 and may have the open end with the lens 110 at a forward end opposite the rearward end. The light source module 100 may further comprise: a circuit board 140 for selectively providing electrical power to the light source 130; or a pair of electrical contacts 129, 144 for receiving electrical power from a source B of electrical power when a source B of electrical power is in the second cavity; or a circuit board 140 for selectively providing electrical power to the light source 130 and a pair of electrical contacts 129, 144 for receiving electrical power from a source B of electrical power when a source B of electrical power is in the second cavity. The electronic circuit board 140 may include a switch 142 and the actuator 80 may actuate the switch 142 for controlling energizing the light source 130 for selectively producing light when a source B of electrical power is in the second cavity. In the portable light 10: the light source 130 may include a light emitting diode 130; or the light source 130 may be mounted to the circuit board for coupling heat from the light source 130 to the heat sink 170; or the light source 130 may include a light emitting diode 130 mounted to the circuit board for coupling heat from the light emitting diode 130 to the heat sink 170.

A portable light module 100 may comprise: a light source 130 for producing light when energized; a reflector 120 for receiving light from the light source 130 and having a surface 122 for reflecting the light produced by the light source 130 towards an open end of the reflector 120; a heat sink 170 attached to the reflector 120 and thermally coupled to the light source 130; a lens 110 covering the open end of the reflector 120; and a lens ring 112 holding the lens 110 adjacent the reflector 120, wherein the light source 130, the reflector 120, the heat sink 170, the lens 110 and the lens ring 112 form an integral module 100 having a given cross-sectional shape and size and placable in a cavity of substantially the given shape and size. In the portable light module 100: the given cross-sectional shape and size may be substantially cylindrical; or the reflector 120 may have an external surface 124 of the given cross-sectional shape and size; or the reflector 120 may have a substantially cylindrical external surface 124 of the given cross-sectional shape and size. The lens ring 112 may press fit on the external surface 124 of the reflector 120 for securing the lens 110 against the open end of the reflector 120. The heat sink 170 may attach at a rearward end of the reflector 120 with the light source 130 thermally coupled thereto, and the reflector 120 may have an opening in the rearward end for receiving light from the light source 130 and may have the open end with the lens 110 at a forward end opposite the rearward end. The portable light module 100 may further comprise: a circuit board 140 for selectively providing electrical power to the light source 130; or a pair of electrical contacts 129, 144 for receiving electrical power from a source B of electrical power; or a circuit board 140 for selectively providing electrical power to the light source 130 and a pair of electrical contacts 129, 144 for receiving electrical power from a source B of electrical power. The electronic circuit 140 board may include a switch 142 actuatable by an actuator 80 for controlling energizing the light source 130 for selectively producing light. In the portable light module 100: the light source 130 may include a light emitting diode 130; or the light source 130 may be mounted to the circuit board 140 for coupling heat from the light source 130 to the heat sink 170; or the light source 130 may include a light emitting diode 130 mounted to the circuit board 140 for coupling heat from the light emitting diode 130 to the heat sink 170.

A portable light 10 may comprise: a light body 20 defining a longitudinal axis 11 between first and second ends 12, 14, and having a cavity for receiving a source B of electrical power therein; a light source 100 proximate the first end 12 of the light body 20 and oriented for emitting light in a direction substantially transverse to the longitudinal axis 11 of the light body 20; a switch actuator 80 proximate the first end of the light body 20 for controlling the light source 100 for selectively producing light, and a clip 70 extending adjacent the light body 20 in a longitudinal direction, wherein the clip 70 is rotatably mounted to the light body 20 so as to be movable adjacent the light body 20 about the longitudinal axis 11 thereof, whereby the light body 20 is positionable relative to an object to which the portable light 10 is attached by the clip 70 for directing the light produced by the portable light 10 over a range of directions. The clip 70 may include a generally rectangular member 72 extending adjacent the light body 20 in a longitudinal direction and a pair of arcuate mounting members 76 rotatably movable in a grove 26 around the light body 20. In the portable light 10: the pair of arcuate members 76 may extend a majority of the way around the light body 20; or the pair of arcuate members 76 may be connected together at their respective ends remote from the generally rectangular member 72; or the pair of arcuate members 76 may extend a majority of the way around the light body 20 and may be connected together at their respective ends remote from the generally rectangular member 72. The clip 70 may include an arcuate mounting member 76 rotatably movable around the light body 20, wherein the light body 20: has a groove 26 around the light body 20 proximate the first end 12 thereof for receiving the arcuate member 76, or has a groove **26*a* around the light body 20 proximate the second end 14 thereof for receiving the arcuate member 76, or has a first groove 26 around the light body 20 proximate the first end 12 thereof and a second groove 26*a* around the light body 20 proximate the second end 14 thereof for receiving the arcuate member 76. In the portable light 10" the light source 100 may emit light substantially perpendicularly to the longitudinal axis of the light body 20; or the light source 100 may be substantially at the first end 12 of the light body 20; or the switch actuator 80 may be at the first end 12 of the light body 20; or the light source 100 and the switch actuator 80 may be substantially at the first end 12 of the light body 20; or the light source 100 and the switch actuator 80 may be substantially at the first end 12 of the light body 20 and the light source 100 may emit light substantially perpendicularly to the longitudinal axis 11 of the light body 20. The portable light 10 may further comprise: a stowable hanger 50 affixed to the light body 20 proximate the first end 12 thereof. The stowable hanger 50 may comprise: a bracket 60 affixed to the light body 20 and defining a relatively straight passage between the bracket 60 and the light body 20, the bracket 60 including a spring finger 62 proximate the passage; and a hanger ring 50 having a relatively straight portion 54 having at least first and second flat surfaces 54*f* thereon disposed in the passage and engaging the spring finger 62 of the bracket, wherein the spring finger 62 of the bracket 60 bears against the first flat surface 54*f* of the hanger ring 50 for biasing the hanger ring 50 to a stowed position and bears against the second flat surface 54*f* of the hanger ring 50 for biasing the hanger ring 50 to a deployed position. The stowable hanger 50 may include a hanger ring 50 having a spring-loaded clip 56 closing an opening in the hanger ring 50. In the portable light 10: the stowable hanger 50 may be affixed to the light body 20 by a fastener 69; or the stowable hanger 50 may be affixed to the light body 20 by a fastener 69 that extends through the light body 20 to engage the light source 100** therein.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "up," "down," "left," "right," "front," "rear," "side," "top," "bottom," "forward," "rearward," "under" and/or "over," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

Further, what is stated as being "optimum" or "deemed optimum" may or not be a true optimum condition, but is the condition deemed to be desirable or acceptably "optimum" by virtue of its being selected in accordance with the decision rules and/or criteria defined by the applicable controlling function, e.g., the desired operating condition of a particular LED 130 or of a type of LED 130.

The term battery is used herein to refer to an electro-chemical device comprising one or more electro-chemical cells and/or fuel cells, and so a battery may include a single cell or plural cells, whether as individual units or as a packaged unit. A battery is one example of a type of an electrical power source suitable for a portable device.

While the present invention has been described in terms of the foregoing example embodiments, variations within the scope and spirit of the present invention as defined by the claims following will be apparent to those skilled in the art. For example, while extension 40 of light body 20 is generally referred to as 90° extension 40, and so may be generally perpendicular to the longitudinal axis 11 of light body 20 and light 20, it may be oriented at a substantially different angle, perhaps at a 75° or an 80° angle, or even as far from perpendicular as a 45° angle.

While light source module 100 may be retained by a fastener, e.g., a screw or bolt, as described, it may be retained in light body 20 by other arrangements. E.g., the O-ring 104 of light source module 100 may provide sufficient friction with the bore 42 of extension 40 to retain light source module 100 therein. E.g., the diameter of light source module 100 may provide sufficient friction with the bore 42 of extension 40 to retain light source module 100 therein. In addition, ribs and recesses, or barbs, a clip, a snap ring, a wire form, or another feature may be provided for retaining light source module 100 in the bore 42 of extension 40 of light body 20.

By way of further example, module 100 may have threads on its outer surface that engage threads on the bore 42 of extension 40 of housing 20. Extension 40, while molded as part of housing 20 in the described example, may be separate therefrom. Extension 40 could be a separate part, e.g., a molded, turned or machined cylindrical part, that is placed into a circular opening in head 24, e.g., as a press fit insert or by being threaded therein, or be held therein by a screw, a pin, barbs, a rib and a recess, a clip, a snap ring, a wire form, or other suitable fastening.

In another example regarding belt/pocket clip 70, arcuate members 76 thereof may reside in a circumferential groove **26*a* near end 14 of elongated body 22 of light body 20 and are movable therein for rotating clip 70 around light body 20 to any position. While clip 70 may be rotated in groove 26*a* around light body fully in either of both directions, only about 200° of rotation is usable when light 10 is attached by clip 70 to a user. In this alternative, clip 70 may be mounted with longitudinal portion 72 thereof either extending upward towards head end 12, i.e. inverted relative to the orientation illustrated which may be useful, e.g., for attaching light 10 to the band of a hat or to the bottom of a pant leg, or even extending downward towards (and beyond) tail end 14, e.g., to provide an extension 72 that may be grasped or clamped for supporting light 10**.

Each of the U.S. Provisional Applications, U.S. Patent Applications, and/or U.S. Patents identified herein are hereby incorporated herein by reference in their entirety, for any purpose and for all purposes irrespective of how it may be referred to herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A portable light comprising:

a light body defining a longitudinal axis between first and second ends, and having a cavity for receiving a source of electrical power therein;

a light source proximate the first end of said light body and oriented for emitting light in a direction substantially transverse to the longitudinal axis of said light body;

a switch actuator at the first end of said light body and closer thereto than is said light source for controlling said light source for selectively producing light, wherein said switch actuator is actuatable by movement in a direction substantially parallel to the longitudinal axis; and a stowable hanger; and a bracket affixed to said light body proximate the first end thereof and pivotably mounting said stowable hanger thereat.

2. The portable light of claim 1 wherein:

said light source emits light substantially perpendicularly to the longitudinal axis of said light body; or said light source is substantially at the first end of said light body; or said switch actuator is at the first end of said light body; or said stowable hanger is substantially at the first end of said light body; or said light source and said stowable hanger are substantially at the first end of said light body with said stowable hanger opposite said light source; or any combination of any of the foregoing.

3. The portable light of claim 1 wherein said stowable hanger and said bracket comprise:

said bracket defining a relatively straight passage between said bracket and said light body, said bracket including a spring finger proximate the passage; and a hanger ring having a relatively straight portion having at least first and second flat surfaces thereon disposed in the passage and engaging the spring finger of said bracket, wherein the spring finger of said bracket bears against the first flat surface of said hanger ring for biasing said hanger ring to a stowed position and bears against the second flat surface of said hanger ring for biasing said hanger ring to a deployed position.

4. The portable light of claim 1 wherein said stowable hanger includes a hanger ring having a spring-loaded clip closing an opening in said hanger ring.

5. The portable light of claim 1 wherein:

said bracket is affixed to said light body by a fastener; or said bracket is affixed to said light body by a fastener that extends through said light body to engage said light source therein.

6. The portable light of claim 1 further comprising:

a clip extending adjacent said light body in a longitudinal direction, wherein said clip is rotatably mounted to said light body so as to be movable adjacent said light body about the longitudinal axis thereof.

7. A portable light comprising:

a light body having a first cavity having a given substantially cylindrical shape and size and having a second cavity for receiving a source of electrical power therein, the first cavity having a substantially circular external opening for receiving a light source module therein;

an actuator on said light body for controlling energizing a light source for selectively producing light when a source of electrical power is in the second cavity, and a light source module having an exterior of the given substantially cylindrical shape and size for being placed into the first cavity of said light body, and defining a central axis of a cylinder, said light source module comprising:

a light source for producing light when energized;

an electrical switch actuatable by said actuator for the controlling energizing of said light source;

a reflector for receiving light from said light source and having a surface for reflecting the light produced by said light source along the central axis towards an open end of said reflector;

a heat sink attached to said reflector and thermally coupled to said light source;

a lens covering the open end of said reflector; and a lens ring holding said lens adjacent said reflector, wherein said light source, said electrical switch, said reflector, said heat sink, said lens and said lens ring form an integral module that is insertable into and securable in the first cavity of said light body.

8. The portable light of claim 7 wherein:

said reflector has an external surface having a circumferential groove therein and an O-ring in said groove.

9. The portable light of claim 8 wherein said lens ring press fits on the external surface of said reflector for securing said lens against the open end of said reflector.

10. The portable light of claim 7 wherein said heat sink attaches at a rearward end of said reflector with said light source thermally coupled thereto, wherein said reflector has an opening in the rearward end for receiving light from said light source and has the open end with said lens at a forward end opposite the rearward end.

11. The portable light of claim 7 wherein said light source module further comprises:

a circuit board for selectively providing electrical power to said light source; or a pair of electrical contacts for receiving electrical power from a source of electrical power when a source of electrical power is in the second cavity; or a circuit board for selectively providing electrical power to said light source and a pair of electrical contacts for receiving electrical power from a source of electrical power when a source of electrical power is in the second cavity.

12. The portable light of claim 11 wherein said electronic circuit board includes said electrical switch and said actuator actuates said electrical switch for controlling energizing said light source for selectively producing light when a source of electrical power is in the second cavity.

13. The portable light of claim 11 wherein:

said light source includes a light emitting diode; or said light source is mounted to said circuit board for coupling heat from said light source to said heat sink; or said light source includes a light emitting diode mounted to said circuit board for coupling heat from said light emitting diode to said heat sink.

14. A portable light module comprising:

a light source module having an exterior of a given substantially cylindrical shape and size for being placed into a cavity of a light body, and defining a central axis of a cylinder, said light source module comprising:

a light source for producing light when energized;

an electrical switch actuatable for the controlling energizing of said light source;

a reflector for receiving light from said light source and having a surface for reflecting the light produced by said light source along the central axis towards an open end of said reflector;

a heat sink attached to said reflector and thermally coupled to said light source;

a lens covering the open end of said reflector; and a lens ring holding said lens adjacent said reflector, wherein said light source, said electrical switch, said reflector, said heat sink, said lens and said lens ring form an integral module having the given substantially cylindrical shape and size and placable in a cavity of the given substantially cylindrical shape and size.

15. The portable light module of claim 14 wherein:

said reflector has an external surface having a circumferential groove therein and an O-ring in said groove.

16. The portable light module of claim 15 wherein said lens ring press fits on the external surface of said reflector for securing said lens against the open end of said reflector.

17. The portable light module of claim 14 wherein said heat sink attaches at a rearward end of said reflector with said light source thermally coupled thereto, wherein said reflector has an opening in the rearward end for receiving light from said light source and has the open end with said lens at a forward end opposite the rearward end.

18. The portable light module of claim 14 further comprising:

a circuit board for selectively providing electrical power to said light source; or a pair of electrical contacts for receiving electrical power from a source of electrical power; or a circuit board for selectively providing electrical power to said light source and a pair of electrical contacts for receiving electrical power from a source of electrical power.

19. The portable light module of claim 18 wherein said electronic circuit board includes said electrical switch actuatable by an actuator for controlling energizing said light source for selectively producing light.

20. The portable light module of claim 18 wherein:

said light source includes a light emitting diode; or said light source is mounted to said circuit board for coupling heat from said light source to said heat sink; or said light source includes a light emitting diode mounted to said circuit board for coupling heat from said light emitting diode to said heat sink.

21. A portable light comprising:

a light body defining a longitudinal axis between first and second ends, and having a cavity for receiving a source of electrical power therein;

a light source proximate the first end of said light body and oriented for emitting light in a direction substantially transverse to the longitudinal axis of said light body;

a switch actuator proximate the first end of said light body for controlling said light source for selectively producing light, and a clip extending adjacent said light body in a longitudinal direction, wherein said clip is rotatably mounted to said light body so as to be movable adjacent said light body about the longitudinal axis thereof, whereby said light body is positionable relative to an object to which said portable light is attached by said clip for directing the light produced by said portable light over a range of directions.

22. The portable light of claim 21 wherein said clip includes a generally rectangular member extending adjacent said light body in a longitudinal direction and a pair of arcuate mounting members rotatably movable in a grove around said light body.

23. The portable light of claim 22 wherein:

said pair of arcuate members extend a majority of the way around said light body; or said pair of arcuate members are connected together at their respective ends remote from said generally rectangular member; or said pair of arcuate members extend a majority of the way around said light body and are connected together at their respective ends remote from said generally rectangular member.

24. The portable light of claim 21 wherein said clip includes an arcuate mounting member rotatably movable around said light body, and wherein said light body:

has a groove around said light body proximate the first end thereof for receiving said arcuate member, or has a groove around said light body proximate the second end thereof for receiving said arcuate member, or has a first groove around said light body proximate the first end thereof and a second groove around said light body proximate the second end thereof for receiving said arcuate member.

25. The portable light of claim 21 wherein:

said light source emits light substantially perpendicularly to the longitudinal axis of said light body; or said light source is substantially at the first end of said light body; or said switch actuator is at the first end of said light body; or said light source and said switch actuator are substantially at the first end of said light body; or said light source and said switch actuator are substantially at the first end of said light body and said light source emits light substantially perpendicularly to the longitudinal axis of said light body.

26. The portable light of claim 21 further comprising: a stowable hanger affixed to said light body proximate the first end thereof.

27. The portable light of claim 26 wherein said stowable hanger comprises:

a bracket affixed to said light body and defining a relatively straight passage between said bracket and said light body, said bracket including a spring finger proximate the passage; and a hanger ring having a relatively straight portion having at least first and second flat surfaces thereon disposed in the passage and engaging the spring finger of said bracket, wherein the spring finger of said bracket bears against the first flat surface of said hanger ring for biasing said hanger ring to a stowed position and bears against the second flat surface of said hanger ring for biasing said hanger ring to a deployed position.

28. The portable light of claim 26 wherein said stowable hanger includes a hanger ring having a spring-loaded clip closing an opening in said hanger ring.

29. The portable light of claim 26 wherein:

said stowable hanger is affixed to said light body by a fastener; or said stowable hanger is affixed to said light body by a fastener that extends through said light body to engage said light source therein.

30. A portable light comprising:

a light body having a cavity for receiving a source of electrical power therein;

a light source supported by said light body and oriented for emitting light in a direction away from said light body;

a switch actuator on said light body for controlling said light source for selectively producing light, and a stowable hanger affixed to said light body for hanging said light body from an object, said stowable hanger comprising:

a bracket affixed to said light body and defining a relatively straight passage between said bracket and said light body, said bracket including a spring finger proximate the passage; and a hanger ring having a relatively straight portion having at least first and second flat surfaces thereon disposed in the passage and engaging the spring finger of said bracket, wherein the spring finger of said bracket bears against the first flat surface of said hanger ring for biasing said hanger ring to a stowed position and bears against the second flat surface of said hanger ring for biasing said hanger ring to a deployed position.

31. The portable light of claim 30 wherein said hanger ring includes a spring-loaded clip closing an opening in said hanger ring.

32. The portable light of claim 30 wherein:

said stowable hanger is affixed to said light body by a fastener; or said stowable hanger is affixed to said light body by a fastener that extends through said light body to engage said light source.

* * * * *